United States Patent [19]

Skelton

[11] 4,069,586

[45] Jan. 24, 1978

[54] CENTER PUNCH

[76] Inventor: Horace C. Skelton, 102 Francis Wyman Road, Burlington, Mass. 01803

[21] Appl. No.: 688,094

[22] Filed: May 19, 1976

[51] Int. Cl.[2] ..... B26F 1/00

[52] U.S. Cl. ..... 30/360; 30/366; 33/191

[58] Field of Search ..... 30/360, 361, 366, 368; 33/191

[56] References Cited

U.S. PATENT DOCUMENTS

| | | | |
|---|---|---|---|
| 949,856 | 2/1910 | Stroh | 33/191 |
| 1,259,335 | 3/1918 | Acton | 30/368 X |
| 2,860,421 | 11/1958 | Smith | 33/191 |

FOREIGN PATENT DOCUMENTS

| | | | |
|---|---|---|---|
| 564,657 | 10/1944 | United Kingdom | 33/191 |

*Primary Examiner*—James L. Jones, Jr.
*Assistant Examiner*—J. T. Zatarga

[57] ABSTRACT

A center punch particularly adapted for locating and marking the center position of a circular opening, as for making a center mark in a stud that has been broken off below the surface, to facilitate drilling and removing the stud. Movable jaws are each provided with an end portion of reduced thickness that extends into the opening adjacent the stud and a shoulder that abuts the exposed surface to retain the punch in a center position.

3 Claims, 3 Drawing Figures

CENTER PUNCH

This invention relates to a center punch for locating and marking the center point on the end of a stud or bolt or other object having a circular cross section. The center punch has particular usefulness in marking the center of a stud or bolt that has been broken off, and is capable of center marking such a stud or bolt whether it has been broken off above or below the surface of the part to which it is secured. When a stud or bolt breaks off within a bore in a metal block, it must usually be drilled out before replacement or repairs can be made. The drill must be positioned concentrically with the bore to avoid damaging the block and this requires a center mark in the end of the broken stud. Locating and marking the center of such a stud is particularly difficult if the surface of the broken stud is not perpendicular to the axis of the bore.

It is an object of the invention to provide a center punch capable of locating and marking accurately the center point of a stud, bolt or other object with a circular cross section and extending from or recessed in a metal surface.

It is another object to provide such a center punch having a plurality of radially movable jaws adapted to engage the inner surface of a bore thereby to position the punch in the center thereof.

Still another object of the invention is to provide such a punch member slidably retained in a barrel having a slotted end portion forming a number of resilient jaws each with an end portion of reduced thickness, adapted to engage the inner surface of a bore, and a shoulder for engaging the outer surface adjacent the bore.

These and other objects will be apparent from the following description of a preferred embodiment of the invention considered in conjunction with the accompanying drawings, in which.

Figure 1:
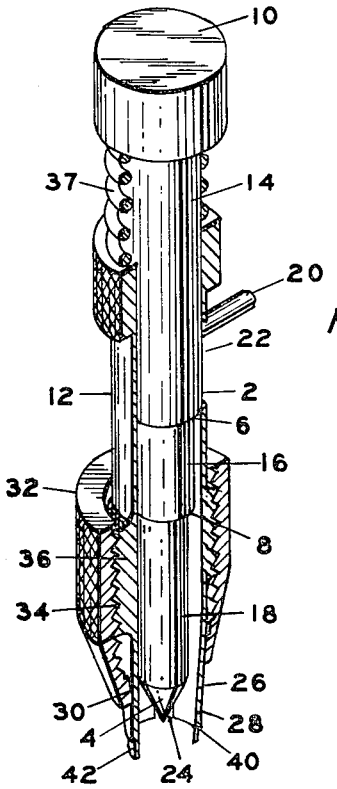
FIG. 1 shows a cross section of a center punch embodying the invention.

Best shown in FIG. 1, a cylindrical punch member, generally indicated at 2, has a hardened tapered end section 4 terminating in a point for locating and indenting the center of a circular object. The upper portion of the punch 2 is of larger diameter resulting in a first shoulder 6 and a second shoulder 8. A cap 10 of still larger diameter is formed integrally with the punch member 2, or it may be formed separately and secured to the upper end of the punch member 2.

The punch member 2 is positioned within a steel barrel, generally indicated at 12, with a section 14 of largest diameter slidably engaging the inner wall of the barrel 12. The smaller diameter portions 16 and 18 of the punch member 2 do not make contact with the walls of the barrel 12. The longitudinal movement of the punch member 2 is limited in each direction by a pin 20 extending from the punch member 2 through a slot 22 in the barrel 12.

The lower end of the barrel 12 is provided with four slots 24 that extend to the end of the barrel 12 to form four circumferentially-spaced jaws 26. The slots 24 are wide enough to allow a significant inward displacement of the jaws 26 by flexing of the metal of the barrel 12, a width of about 1/16 inch being satisfactory for most uses. The lower portion of each jaw 26 is reduced in thickness to form an exterior taper, as at 28. This tapered surface 28 engages a circular lip 30 that extends inwardly from the lower edge of a collar 32, which is provided with internal threads, as at 34, that engage a raised threaded section 36 on the outer surface of the barrel 12. As the collar 32 is turned to move the collar upwardly away from the jaw end of the barrel 12, the lip 30, engaging the tapered surfaces 28, forces the jaws 26 to move radially inwardly; as the collar is turned in the opposite direction, to release the force on the jaws 26, the jaws are forced outwardly by the spring action of the metal.

To bias the punch member 2 in its uppermost position, as limited by the pin 20 in the slot 22, a coil spring 37 is positioned around the punch 2 and held in compression between the lower surface of the cap 10 and the upper surface of a knurled enlarged section formed on the outer surface of the barrel 12.

Figure 2:
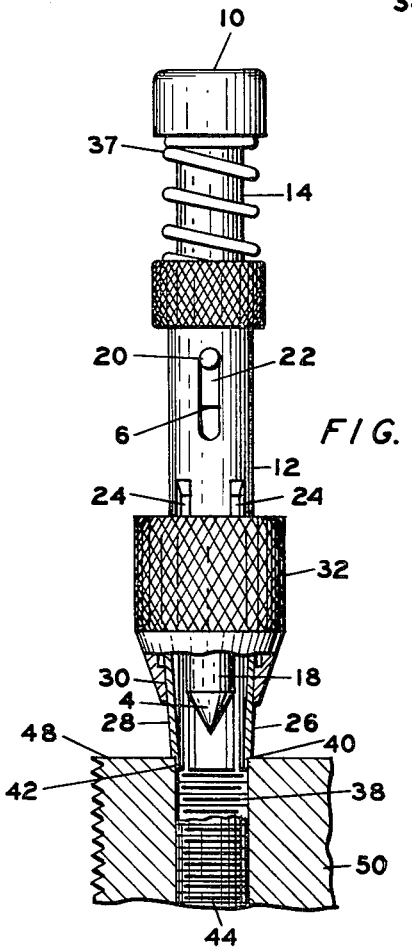
FIG. 2 is an elevational view showing the punch positioned in the bore of a metal block to center mark the end of a stud broken off below the surface of the block, the block and a portion of the punch being shown in section to better show the construction.

To hold the barrel 12 in concentric position with respect to a bore 38, as shown in FIG. 2, each of the jaws 26 is provided with a shoulder 40 extending perpendicularly from the axis of the barrel and which is formed by reducing the thickness of each jaw for a short distance from its free end so as to form a vertical surface 42 that extends typically for 1/32 inch or more from the free end of each jaw 26.

In use, to center mark the end surface of a stud 44 (FIG. 2) that has been broken off below the surface 48 of a metal block 50, the collar 32 is turned to move it upwardly and force the jaws 26 to move inwardly enough to permit the lower end portions of the jaws 26 to enter the bore 38. The collar 32 is then turned in the opposite direction to allow the jaws to spring outwardly and bring the surfaces 42 into engagement with the inner surface of the bore 38 with the surfaces of the shoulders 40 engaging the upper surface of the block 50. The barrel 12, and thus the punch member 2, is firmly centered on the bore and prevented from moving downwardly by the shoulders 40. The cap 10 is then struck by a hammer to drive the punch member 2 downwardly against the force of the spring 37 and produce an indentation in the center of the upper surface of the stud. The shoulders 40 abutting the block surface 48 assist in maintaining the axes of the punch member 2 and the bore 46 in alignment.

Figure 3:
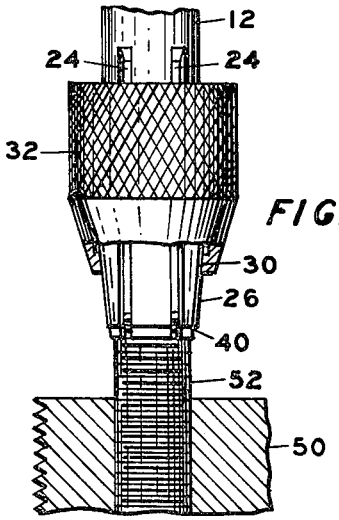
FIG. 3 is a partial view, similar to FIG. 2, showing the punch positioned on a stud extending above the surface of the block.

FIG. 3 shows the punch being used with a stud 52 that has been broken off above the surface of the block 50. The collar 32 is turned to move it downwardly and release the jaws 26 to spring outwardly sufficiently to allow the barrel to fit over the stud 52. The collar is then turned in the opposite direction to force the jaws inwardly into snug contact with the stud 52. The cap 10 is then struck with a hammer to center mark the end of the stud 52.

From the foregoing it will be apparent that the center punch embodying my invention is well adapted to attain the ends and objects hereinbefore set forth and to be economically manufactured and that it is subject to various modifications to adapt it for particular conditions of use.

I claim:

1. A center punch comprising a tubular barrel having a plurality of parallel slots extending from one and thereof thereby to define a plurality of spaced circumferentially-positioned jaws, each of said jaws having a tapered external surface, a punch member having a point at one end thereof, means slidably retaining said punch member for longitudinal movement within said barrel, and clamping means releasably forcing said jaws inward comprising a collar in threaded engagement with said barrel and in compressive engagement with said tapered surfaces whereby adjustment of said collar causes radial movement of said jaws.

2. A center punch as claimed in claim 1 including a spring arranged to bias said punch member longitudinally in a direction away from said jaws.

3. A center punch as claimed in claim 1 wherein each of said jaws includes a shoulder on its outer surface adjacent but spaced from the free end of said jaws, each of said shoulders forming a surface perpendicular to the longitudinal axis of said barrel, all of said shoulder surfaces lying in a common plane.

* * * * *